US006743111B2

(12) United States Patent
Mindlin

(10) Patent No.: US 6,743,111 B2
(45) Date of Patent: Jun. 1, 2004

(54) METHOD AND APPARATUS FOR GOLF INSTRUCTION

(76) Inventor: Richard B. Mindlin, 4101 W. 90th St., Shawnee Mission, KS (US) 66207-2325

( * ) Notice: Subject to any disclaimer, the term of this patent is extended or adjusted under 35 U.S.C. 154(b) by 0 days.

(21) Appl. No.: 10/127,621

(22) Filed: Apr. 22, 2002

(65) Prior Publication Data

US 2003/0022725 A1 Jan. 30, 2003

Related U.S. Application Data

(63) Continuation-in-part of application No. 09/915,141, filed on Jul. 25, 2001.

(51) Int. Cl.[7] ..... A63B 57/00; A63B 69/36
(52) U.S. Cl. ..... 473/218; 473/270; 473/267
(58) Field of Search ..... 473/218, 267, 473/162, 229, 270, 278

(56) References Cited

U.S. PATENT DOCUMENTS 4,164,352 A * 8/1979 O'Brien ..... 473/218
4,181,307 A * 1/1980 Krene et al. ..... 473/267
4,563,010 A * 1/1986 McDorman et al. ..... 473/267

* cited by examiner

*Primary Examiner*—Gregory Vidovich
*Assistant Examiner*—M. Chambers
(74) *Attorney, Agent, or Firm*—Lathrop & Gage LC

(57) ABSTRACT

A golf instructional device is provided for designating proper setup positioning for swinging a golf club and for monitoring the location of a user's eyes while swinging the club, such a mat being customized for an individual golfer. The device comprises a mat for providing a playing surface upon which foot positioning markers and a club positioning marker are placed. A mirror is coupled to the mat and is preferably located adjacent to the mat surface. The markers are designed to be removably attached to the mat surface. The markers are adjustable to allow a golf instructor to indicate proper location and angle for the user to position themselves and the club which they are swinging. The mirror is of a chosen size such that when properly angled by the instructor, the user can essentially only observe his or her eyes while swinging the golf club. A wedge is also provided to be positioned underneath a portion of the user's rearward foot to train the user to maintain a near stationary rear leg during the backswing. The user stands on top of the mat surface and aligns his or her feet with the foot positioning markers, aligns a golf club with the club positioning marker, and positions his or her body such that essentially only his or her eyes are viewable in the mirror. When the user makes practice swings the golf club, excessive lateral and vertical motion can be observed in the mirror.

14 Claims, 4 Drawing Sheets

METHOD AND APPARATUS FOR GOLF INSTRUCTION

RELATED APPLICATIONS

This application is a continuation-in-part application which claims the priority of prior application Ser. No. 09/915,141, entitled "METHOD AND APPARATUS FOR GOLF INSTRUCTION", filed Jul. 25, 2001, which is hereby incorporated by reference into this application.

BACKGROUND OF THE INVENTION

1. Field of the Invention

This invention relates generally to methods of teaching and devices for improving a golfer's skill and ability, and more specifically, for designating proper setup position for swinging a golf club and for monitoring the position of a user's head during swinging of the club.

2. Description of the Related Art

Golf is a sport that has become exceedingly popular all over the world. It is estimated that about two million people in the United States alone take up the game of golf every year. However, about as many people leave the game each year, largely because they are disappointed and frustrated over their inability to improve their golf technique. It is generally believed by leading golf instructors that it is difficult to improve at golf because (a) the essential fundamentals of a good golf swing feel unnatural to our bodies, (b) all natural instincts of students are absolutely wrong, (c) correct habits must be practiced over and over again to develop new and correct habits ("muscle-memory") and (d) while practicing to develop new muscle-memory, students must not be practicing bad habits that result in bad muscle-memory that will eventually have to be unlearned. As generally believed by leading instructors, bad muscle-memory is harder to unlearn than it is to learn good muscle-memory from the start.

To improve their abilities, many golfers take lessons from professional golf instructors. Although such lessons can teach an individual the fundamental skills needed to play the game, these golfers are most often not able to improve their golf club swing as much as desired because of a lack of guidance when practicing outside of the instructional setting. Most often students practicing without an instructor revert to, and practice, what feels natural but is in reality bad technique, thereby developing bad muscle-memory. As an alternative to lessons, self-instruction devices have been developed by others to allow golfers to improve their game by themselves. This approach has a downside in that such devices must be used in the proper fashion to create positive results, which is often difficult for a beginning or high handicap golfer who may have already developed bad habits. Further, even if used properly, these devices are often not proven to aid in proper development of a golfer's club swing technique because, as believed by leading instructors, golf is not a sport that can be self-taught; only with good coaching can the naturally wrong instincts be replaced with the correct fundamentals that initially feel instinctively wrong.

Finally, a deficiency with both professional lessons and self-instruction devices is a lack of a reliable means for monitoring correct "setup position" and monitoring correct balance during the entire swing. Without a way to monitor correct "setup" and "balance", most students fail to practice them correctly to develop the correct and necessary muscle-memory. Instead they develop bad muscle-memory.

U.S. Pat. No. 5,603,617 of Bergman describes a practice mat for golfers that indicates the suggested placement of the feet of a golfer and a golf ball to be hit, the proper alignment of a golf club in relation to the feet of the golfer and the golf ball, and the suggested direction of travel of the head of the golf club. The mat has a plurality of outlines in the shape of a foot to indicate the suggested foot placement based on the chosen golf club. Also, numerous rectangles are indicated on the mat for placement of the golf ball based on the chosen golf club. However, the practice mat of Bergman does not provide a means for the user to monitor and isolate any position of his or her body during swinging of a golf club, nor does it aid in prohibiting a golfer from introducing excessive motion sideways, up or down into his or her technique.

U.S. Pat. No. 5,603,617 of Light shows a sports training device having a full length mirror to reflect the image of a user and a combined television monitor and video cassette player to depict the optimal positioning and technique of a participant in the selected sports activity. Thus, a golfer could view his or her image in the mirror while watching a monitor below the mirror show the proper way to swing a golf club. This device does not teach proper foot positioning or proper club alignment for swinging a club, nor does it provide a means for a golf instructor to designate as such. It is also doubtful that a user of the device could view a monitor showing an ideal golf swing while observing his or her own swing in a full length mirror. Further, the large mirror size and lack of proper indicia would not allow the device to properly isolate a golfer's excessive motion sideways, up or down to enable correction of a flawed golf club swing. This device also lacks convenient portability.

U.S. Pat. No. 4,181,307 of Krene describes a golf training device comprising a platform on which a golfer stands, a platform upon which a golf ball placement indicating means is located, and a mirror extending along the length, and between, the two platforms to enable the user to see his or her golf club swing as they hit the golf ball located on the adjacent platform. The device comprises three units that are hinged together along longitudinal edges. However, Krene does not teach a device that can be used in conjunction with golf instruction having indicating means capable of being adjusted to tailor such a device to the needs of a specific golfer. The foot placement and ball placement means not adjustable in position or angle depending on the needs of a particular user. The mirror in the Krene invention is excessively large and has longitudinal lines that would be ineffective at isolating a small portion of a user's swing, preventing the user from pinpointing excessive lateral and/or vertical motion in his or her swing. Further, a user of the Krene device could not accurately view a small portion of his or her image while focusing on a golf ball to be hit off of a platform adjacent to the mirror.

As an improvement over these methods and devices of instruction, it would be desirable to have a device and instruction kit that would ideally be used along with proper professional golf lessons. The device would have indicating means that can be adjusted by a instructor to ensure each individual user observed proper positioning form when preparing to swing a golf club. Such a device should also allow users to monitor and isolate a specific component of their swing, namely excessive motion sideways, up or down, (i.e. lateral and vertical motion) whether in the company of an instructor or not, to ensure that proper technique is being used. A further benefit of such a device would be portability such that the device can be used in either the location where instruction is taking place or wherever the user desires to practice his or her golf swing. Further, an instruction manual can be provided with the device to enable a golfer to successfully practice his or her golf club swing frequently at any location to correctly muscle-memorize what a golf instructor taught during each of a series of lessons. Although the concept of a prescribed program of at-home practice in slow motion without a ball is almost totally unused today, new research shows that it was frequently prescribed by the most respected instructors of previous generations. Thus, a combination device and instruction manual would be an addition to the at-home practice prescribed in earlier generations. Making it easy for students to practice and develop muscle-memory "at-home" or away from the formal instructional setting is of great importance because so few students find it possible to take lessons or go to a practice range away from home as often as is necessary to develop accurate and long lasting muscle-memory.

Thus, what is needed is a device that can be used in conjunction with an overall golf instructional program to aid a golfer in developing a proper golf swing. The device would ideally designate proper setup positioning and alignment for a user's feet, hands, head, center of the body and golf club handle position (distance from the body) and the angle of the shaft. A simulated golf ball marker can be included with the device, and is placed on the mat to point to a position off the mat indicating where a golf ball should be placed to help the student practice the shaft angle recommended by the instructor. A mirror would also be included with the device to allow the golfers to isolate and monitor the position of their heads, specifically their eyes, while swinging a practice golf club to ensure that head movement does not exceed the instructor's recommendations. Also vitally important to the design of the device is the ability of a golf instructor to adjust the position indicators, the mirror and the golf ball marker based upon the individual needs of the user, or as the muscle flexibility of the golfer increases with practice. Further, an instructional manual can be used in conjunction with the device such that the user is able to properly replicate the skills learned during each lesson taught by the golf instructor and shown in the manual.

SUMMARY OF THE INVENTION

The present invention provides a golf instructional device that designates proper setup positioning for swinging a golf club and allows for monitoring of the location of a user's head while swinging the club when practicing without a ball. The device, or mat, has a surface upon which a user stands and upon which specific foot and club positioning markers are located. A mirror is coupled to the mat and is preferably located adjacent to the mat surface. The markers are designed to be removably attached to the mat surface. Both the markers and the mirror are adjustable to allow a golf instructor to indicate proper location and angle for the user to position themselves and the club which they are swinging. The mirror is of a chosen size such that when tilted to the proper angle by the instructor, the user can essentially only see his or her eyes during a substantial part of the user's golf swing if such a swing demonstrates the proper form to eliminate excessive lateral and/or vertical motion. Additionally, a centering marker, a golf ball marker, and a wedge may be removably attached to the mat surface. The centering marker further pinpoints the proper setup position of the user; the golf ball marker indicates a position off the mat where a golf ball is to be placed such that a golf club head is properly positioned at setup immediately aft of the ball; and the wedge is placed under a portion of the user's back foot to aid in reducing excessive lateral and/or vertical motion in the user's swing. A loop and toggle device, or other similar closure device, can be provided to allow the mat to be folded and conveniently carried for transporting the mat between the location of golf instruction and another location where the user desires to practice his or her golf swing. An instructional manual can also be provided to allow the students to, in conjunction with the positioning markers and mirror as arranged by a golf instructor on or adjacent to the mat, replicate the skills learned in a golf lesson at any location the user desires. Further, the manual could be used as a tool to reinforce a proper golf club swing after the user has learned how to "muscle-memorize" or develop good habits with the device.

The golf instruction device and instruction manual of the present invention work together to increase the permanency and speed of teaching and learning a fundamentally correct golf swing. The mat both permits an instructor to designate customized and correct pre-swing setup positioning for the student, and permits the student to monitor the correctness of certain critical segments of the swing when practicing alone at home. The instruction manual describes and illustrates the pre-swing setup and the swing steps the instructor teaches in a series of lessons which the student practices "at-home". The "at-home" practice is ideally in slow-motion without a ball. The practice is effective with a regular length club or with an indoor short club used where swing space is limited. The lessons in the manual are organized to conform with what the instructor teaches in each of the series of instructor-conducted lessons. The lessons are also organized so the student develops good muscle-memory in stages without simultaneously developing bad muscle-memory.

It is therefore an object of the present invention to provide: a golf instructional device that is easily adjustable by the instructor to allow the designation of proper setup positioning depending on the needs of a particular user. It is a further object of the present invention to provide such a device that allows the user to specifically and reliably monitor excessive lateral and/or vertical motion in his or her golf club swing. It is yet another object of the present invention to provide such a device and instructional manual that allows the user to replicate at any location what was learned from the instructor during lessons, such a device and instructional manual being light weight, durable, simple to use and conveniently portable.

Other advantages and components of the present invention will become apparent from the following description taken in conjunction with the accompanying drawings, which constitute a part of this specification and wherein are set forth exemplary embodiments of the present invention to illustrate various objects and features thereof.

DETAILED DESCRIPTION OF THE INVENTION

Figure 1:
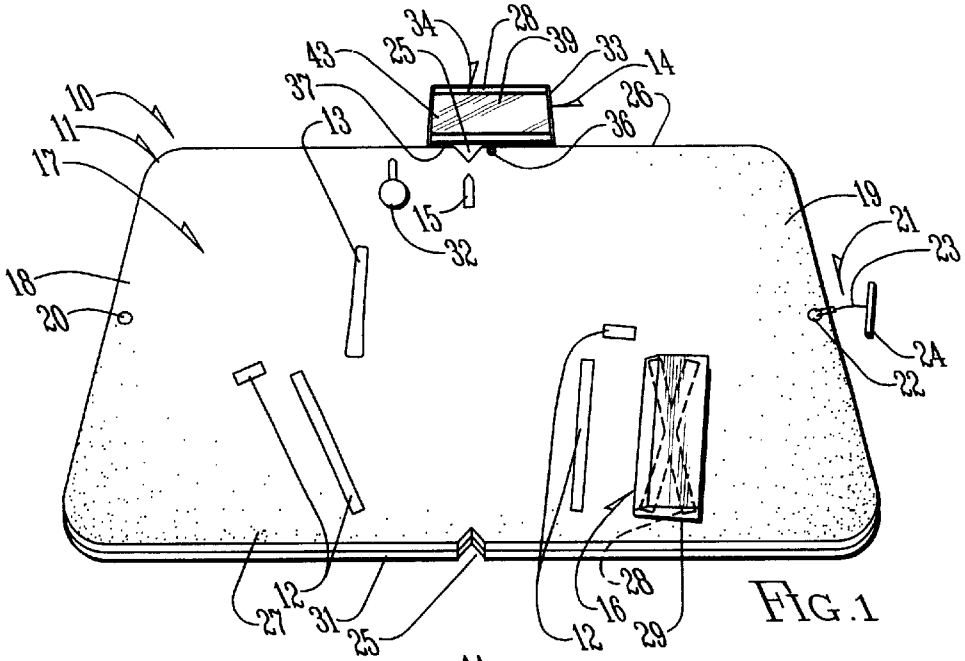
FIG. 1 is a perspective view of a golf instructional device according to the present invention.
Figure 2:
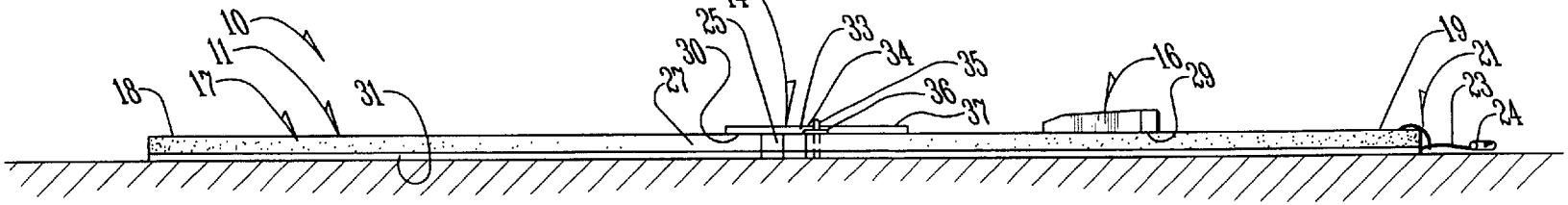
FIG. 2 is a front elevational view of the golf instructional device according to the present invention.

Referring now to the drawings, FIGS. 1, 2, and 4–6 shows a golf instructional device 10 in accordance with the present invention. The instructional device 10 comprises generally a support mat 11, two or more foot positioning markers 12, a club positioning marker 13, and a mirror and frame assembly 14 cooperating to permit an instructor to designate the proper setup positioning for a student to practice swinging a golf club and to allow the user to monitor the location of his or her eyes until a simulated post-impact position is reached. In the preferred embodiment, the present invention also includes a centering marker 15 to designate a reference point for positioning the user's body on the support mat 11, a wedge 16 adapted to be placed under a portion of the user's foot most rearward in the direction of the golf ball flight, and a golf ball marker 32 on the mat to designate a point off the mat where a golf ball is to be placed such that the user will locate the golf club head during setup positioning at the proper longitudinal position in the direction of club swing.

Figure 4:
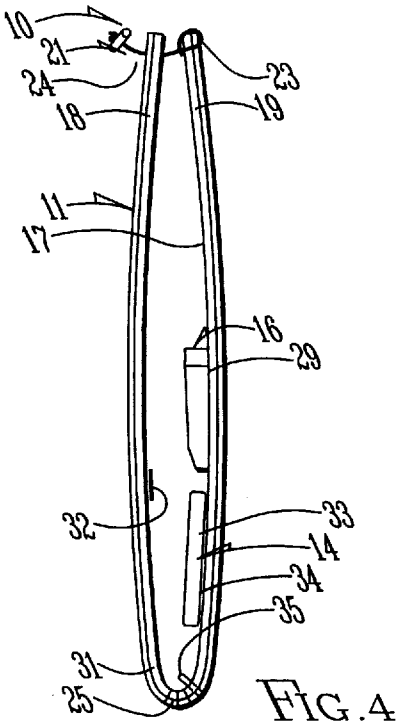
FIG. 4 is a front elevational view of the golf instructional device according to the present invention showing the mat in the folded position and secured by a closure mechanism.

The support mat 11 has a top surface 17, a bottom surface 31, a first end 18 and a second end 19, and provides a stable, yet flexible surface upon which an individual can stand to swing a golf club and upon which the other components of the present invention are securely placed. The mat 11 is of a sufficient size as to accommodate golfers of various sizes and to allow adequate room for adjustments of the positioning and monitoring components for such golfers. Typically, a mat 11 of about three feet in the length and two feet in width would be sufficient. Also, because there is no need for the mat 11 to be rigid, as the mat 11 is typically placed on a level, solid surface such as pavement or the ground, the mat 11 does not have to be very thick. The mat 11 should have a thickness of at least ¼ of an inch, preferably more. However, for the embodiment of the current invention where the mat 11 can be folded, as seen in FIG. 4, the mat should not be so thick as to prevent it from being folded with minimal physical effort. The bottom surface 31 is preferably made from abrasion resistant materials that also have high frictional properties such that the mat 11 does not easily slide across a surface. The top surface 17 must be made of materials that are sufficiently durable as to withstand extended use with any type shoe, including golf shoes with spikes. Preferably the top surface 17 of the mat 11 is made of a fabric material that will allow for attachment of the hook component of a hook and loop fastener system, such as that sold under the trade name VELCRO®. In this configuration, the top surface 17 serves as the loop component of the hook and loop system. This design would allow for easy removal and readjustment of any of the components upon which the hook mechanism is secured. However, any system known in the art for removably attaching components to a support mat can also be utilized.

In the preferred embodiment of the present invention, the first end 18 of the support mat 11 has a first hole 20 for receiving a closure mechanism 21 attached to the second end 19 of the mat 11 through second hole 22. The closure mechanism 21 consists generally of a cord 23 looped through the second hole 22 and secured to a cylindrically-shaped wood toggle 24. In addition to wood, the toggle 24 may be fabricated from plastic or any other material known in the art to be sufficiently lightweight and durable for acting as a handle in carrying the instructional device 10. When the user desires to transport the instructional device 10 to another location, the support mat 11 can be folded in half such that the first and second holes 20 and 22 are substantially aligned. The user then inserts the toggle 24 through the first hole 20 to secure the mat 11 in the folded position and can use the toggle 24 as a handle for carrying the instructional device 10, as shown in FIG. 4. Although a toggle mechanism is shown, any closure mechanism for coupling the first end 18 and second end 19 of the mat 11 together to fold the mat may be used, such as a snap-type closure or fabric loop, or any method known in the art for securing two flexible ends of an object together. The flexible nature of the support mat 11 also allows for easy folding and portability of the present invention.

The foot positioning markers 12, the club positioning markers 13, the centering marker 15, and the golf ball marker 32 are formed from the hook component of a hook and loop fastener system, and can be removably attached to the top surface 17 of the support mat 11. However, any material known in the art for removably attaching components to a support mat can also be utilized for the markers. The foot positioning markers 12 are also generally rectangular in shape, but can be of any shape or configuration known in the art to designate the proper positioning for a golfer to swing a golf club. The markers can also be formed from other materials such as cloth, metal, wood or synthetics, with the hook component of a hook and loop system attached to the underside of the marker.

The centering marker 15 may be rectangular in shape with a pointed end to designate a position on the top surface 17 of the support mat 11 about which the user will center his or her body when preparing to swing a golf club. V-shaped notches 25 can be cut into the forward 26 and rearward 27 edges of the support mat 11 to serve the purpose of permanently designating a centering position for the user. However, other markers, such as studs, can be used as an alternative to the v-shaped notches 25 so long as they would securely and permanently designate the centering position for the user.

A set of foot positioning markers 12 are supplied for each of the user's left and right feet. The markers 12 are generally rectangular in shape and of a sufficient size to allow a golf instructor to designate the proper position and angle of the markers 12 for each foot based on the individual needs of the user. The angles of the feet, which are positioned according to the foot markers, can affect how far the hips can rotate, which can affect the length of the golf club's swing path. To designate such a position and angle, the markers 12 for each foot are placed at right angles to each other to show the proper toe placement positions of the user's foot along with the angle of alignment of the foot. The user will align the inside of one shoe sole immediately adjacent to one marker 12 while placing his or her shoe toe of the same shoe sole immediately adjacent to the other marker 12. This process is then repeated for the other foot by using two more markers 12. The position and angle of the foot positioning markers 12 will be changed by a golf instructor as the user's flexibility increases with practice.

In the preferred embodiment of the present invention, a wedge 16 is placed behind the most rearward foot positioning marker 12 of the user (i.e. behind the right foot marker of a right-handed golfer or behind the left foot marker of a left-handed golfer). The wedge 16 is generally rectangular in shape with a sloped or rounded edge along one of its longitudinal sides and is ideally aligned with the adjacent rearward foot positioning marker 12. The wedge can be made of wood or synthetic materials that are sufficiently strong to support a portion of the weight of a user, whether applied by flat soled shoes or golf spikes. To utilize the wedge 16, the user will stand with at least a portion of his or her rearward foot on top of wedge 16 such that the rearward foot is aligned with the foot positioning marker 12. More specifically, the user places the outside portion of his or her shoe sole on the wedge 16.

The prime objective of the wedge 16 is to aid in training the golfer to maintain a near-stationary right leg during the entire backswing to enhance control over the user's "sway" in the rearward direction of swing. Additionally, maintaining a stationary right leg during the backswing generates great pressure in the right leg. When the backswing is completed, the leg pressure is relaxed and an automatic spring-back of the right leg and hips occurs at the start of the downswing. This spring-back effect helps the lower body move forward ahead of the upper body to assist the golfer in moving the hips forward before the upper body begins the downswing, the proper form in swinging a golf club. To allow for removable attachment of the wedge 16 to the top surface 17 of the support mat 11, a hook component 28 of a hook and loop fastener system can be affixed to the bottom surface 29 of the wedge 16. The hook component 28 can be of any shape to sufficiently secure the wedge 16 to the mat 11, such as a cross configuration shown in FIG. 1, and preferably is adhesively attached (i.e., self-adhesive) to the bottom surface of the wedge 16.

The club positioning marker 13 is generally shaped as the gripping handle of a club, having a slight taper, and allow the golf instructor to designate the proper position, angle, and alignment of the golf club shaft held by the user to setup for the proper swinging of the club. This also ensures that the golfer's hands are correctly positioned in relationship to his or her body. As with the foot positioning marker 12, the club positioning marker 13 is positioned on the mat by a golf instructor according to certain individual characteristics of the user. A golf ball marker 32 is also positioned by an instructor on the mat at a location as to designate the proper location off the mat of a golf ball, such that the golf club head may be properly positioned at setup immediately aft of the ball. Once the instructor positions the golf ball marker 32, it is not moved by the user. The golf ball marker 32 can also have the hook component 28 of a hook and loop system attached to a portion of the surface of the marker such that the marker can be removably attached to the mat 11.

Figure 6:
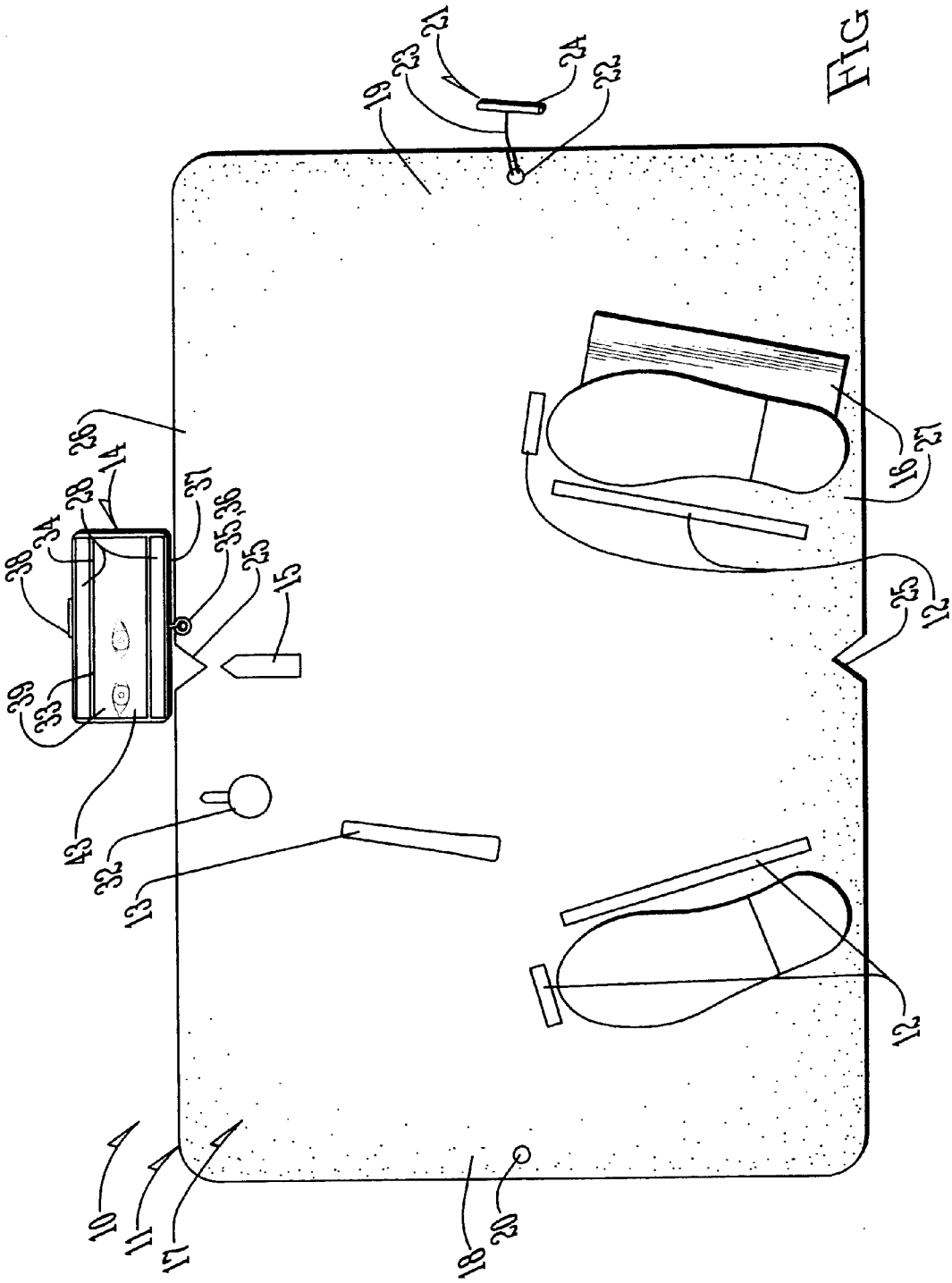
FIG. 6 is a top plan view of the golf instructional device according to the present invention showing a golfer observing his eyes in the mirror.

The mirror and frame assembly 14 is designed to allow the user to view his or her eyes during the setup and the swing until after impact with the ball, as seen in FIG. 6. To accomplish this goal, the mirror and frame assembly 14 is configured to be set at an angle relative to the mat surface 17 and to be sufficiently small such that when it is properly positioned, the user is essentially only able to view his or her eyes. The mirror and frame assembly 14 is comprised of a block frame 33 and a reflective mirror 43 mounted thereon, both of which preferably have a rectangular shape. However, the reflective mirror 43 can be of any shape as to focus the user's line-of-sight on his or her eyes in the reflected image, such as round, oblong, or square. Preferably, the reflective mirror 43 has a length in the direction of the swing of less than about 6 inches, a width of less than about 2.5 inches, and a thickness of less than about 0.25 inches. More specifically, an ideal size has been found to be a length of 4.5 inches, a width of 1.75 inches, and a thickness of 0.125 inches. Also, the reflective mirror 43 is preferably made of acrylic, but can be formed from any material known to provide a reflective surface. The mirror and frame assembly 14 is preferably positioned off the mat surface 17 and either abuts, or is located near, the mat forward edge 26 such that the user standing on the surface can readily see his or her eyes in the reflective mirror 43 while keeping his or her head positioned at the correct angle relative to the ground for proper club swing form. However, if a sufficiently large mat 11 is used (e.g., a mat with a width larger than two feet), the mirror and frame assembly 14 could be positioned on the mat surface 17 near the mat forward edge 26 and still provide the same functionality.

Figure 3:
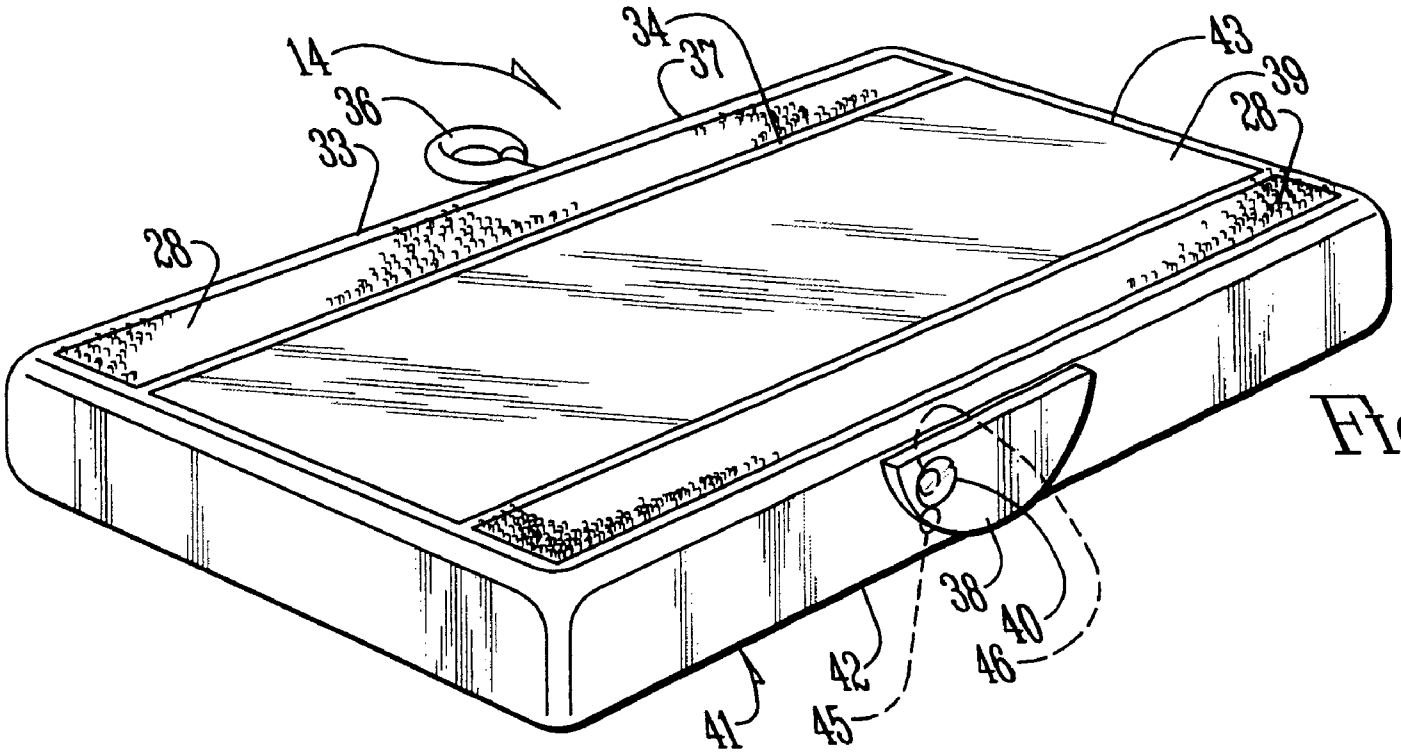
FIG. 3 is a perspective view of the mirror and frame assembly of the present invention showing the angular adjustment means used by an instructor to properly angle a reflective mirror for an individual user.
Figure 5:
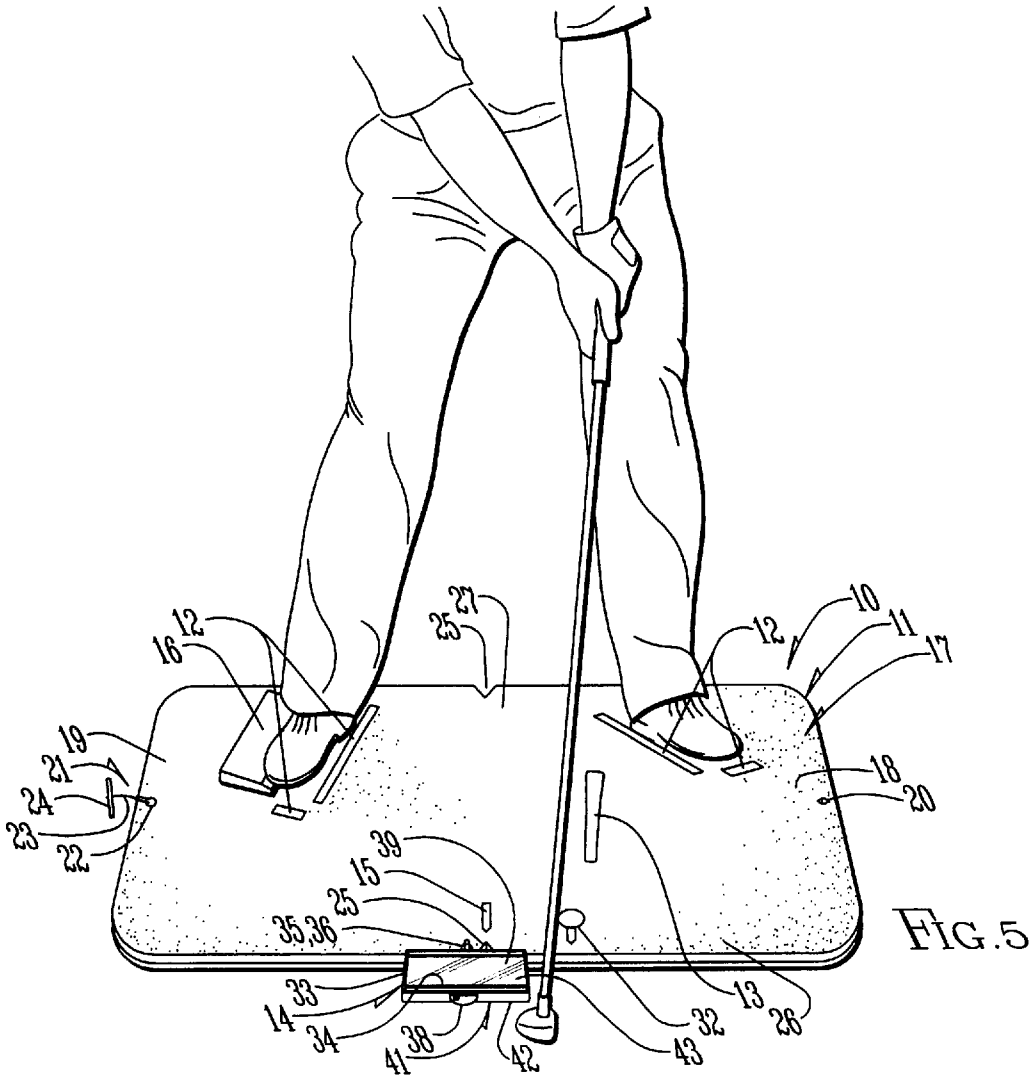
FIG. 5 is a perspective view of the golf instructional device according to the present invention showing one of the positions a right-handed golfer may assume in golf club swing training.

As seen in FIG. 3, the frame 33 is used to provide a stable surface onto which the reflective mirror 43 is mounted. The frame 33 can be of any configuration that will support a mirrored surface, and preferably is a wood block having a length at least as large as the reflective mirror length and a width larger than the reflective mirror width. For an ideal sized reflective mirror 43 (i.e. length of 4.5 inches and width of 1.75 inches), the frame 33 has a length of 4.5 inches and a width of 3.25 inches. The frame 33 has a flat top surface 34 for accepting the reflective mirror 43 and a pair of hook components 28 of a hook and loop system thereon. The hook components 28 are configured to attach the mirror and frame assembly 14 to the mat surface 17 for storage or transportation, as seen in FIG. 4. The reflective mirror 43 and hook components 28 can be affixed to the frame top surface 34 by any means, including adhesively attaching them to the surface. The hook components 28 are generally spaced on either side of the reflective mirror 43.

To connect the frame 33 supporting the reflective mirror 43 to the mat 11, a screw-peg 35 and corresponding eye-screw 36 are provided. The screw-peg 35 is mounted in the mat 11 and extends vertically above the mat top surface 17 near the mat forward edge 26. The screw-peg 35 may be mounted by drilling a hole through the mat 11 and extending the screw from the bottom side up through the mat 11 to extend out of the top surface 17. A nut (not shown) may then be threadingly received around the screw-peg 35 to secure the screw-peg to the mat 11. The eye-screw 36 is mounted to a first side 37 of the frame 33 by screwing the eye-screw into the frame such that it extends laterally outward therefrom. The eye-screw 36 is sized and configured to slide over the top of the screw-peg 35 to surround the screw-peg and affix the position of the mirror and frame assembly 14 on the mat surface 17, or off the mat surface along or near the mat forward edge 26. In this configuration, the mirror and frame assembly 14 cannot move laterally away from the mat 11 or longitudinally, either on the mat surface 17 or off the mat surface along or near the mat forward edge 26, without being lifted upward a sufficient distance as to slide the eye-screw 36 off the top of the screw-peg 35. Thus, when the user is in proper setup position on the mat surface 17 using the markers 12, 13 and 15, the reflective mirror 43, when tilted to the necessary angle, is correctly located such that the user can view his or her eyes in the mirror. Preferably, the screw-peg 35 is ½ inches long and has a diameter of 3/32 inches, and the eye-screw 36 has a eyehole with a diameter of at least 3/32 inches such that it may be slid over the screw-peg. If necessary for increased stability of the mirror and frame assembly 14, another screw-peg 35 and eye-screw 36 may be implemented. Additionally, if it is desired to position the mirror and frame assembly 14 further away from the mat 11, allowing certain users to more properly position their head at the correct angle relative to the ground, the eye-screw 36 can be of a relatively long length as to move the mirror and frame assembly away from the mat forward edge 26 when such eye-screw is slid over the screw-peg 35.

An angular adjustment means 38, preferably an adjustable cam, is employed to set the angle of the mirror and frame assembly 14 relative to the mat surface 17. This will facilitate positioning of a surface 39 of the reflective mirror 43 orthogonal to the line of sight of a particular user standing on the mat 11. In this way, the line-of-sight of the user will follow a line to the mirror and reflect back on itself such that the user can see his or her eyes directly in the mirror and frame assembly 14. The cam 38 is generally a rounded or oblong object with a curved surface and has an aperture disposed substantially at one end into which a fastener 40 is extended. Preferably, the cam 38 is a half metal disc and the fastener 40 is a screw that screws into a hole 46 drilled into a second side 41 of the frame 33 opposite of the first side 37 to mount the cam to the frame. By way of use, the fastener 40 can be loosened to allow the cam 38 to rotate about the fastener, raising or lowering the vertical position of the lowermost point of cam depending on the direction of rotation. The cam 38 is sized to extend below a bottom edge 42 of the frame 33 such that the cam contacts a surface located below the frame 33 and mat 11 upon rotation downward to push the second side 41 of the frame upward relative to the first side 37 of the frame and the mat surface 17. This movement rotates the mirror surface 39 away from the flat, horizontal position such that a user standing on the mat surface 17 will have the mirror tilted towards themselves. The fastener 40 is then tightened to affix the mirror and frame assembly 14 at the desired angle. To allow for the correct angle of mirror tilt for golfers of many sizes, it has been found that a cam having a height of about 1.5 inches, when used with the frame 33 having a width of 3.25 inches, produces the desired range of mirror positions. Additionally, if the angle of mirror tilt needs to be further increased (for example, with shorter golfers), a second hole 45 can be drilled into the second side 41 of the frame 33 below the first hole to accept the cam fastener 40 therein and mount the cam 38 such that it may rotate a greater distance below the frame bottom edge 42.

The instructor will typically set the positions of the foot positioning markers 12 and have the user assume the proper setup stance on the mat 11 prior to setting the angle of tilt of the mirror and frame assembly 14. During the backswing and forward swing up until after impact, or simulated impact, the user looks into the reflective mirror 43 and notices whether there is excessive movement of his or her eyes. Because the reflective mirror 43 is sufficiently small as to isolate the eyes, the user has a simple reference point for observing excessive lateral or vertical motion during practice swings: if the user is unable to observe his or her eyes in the reflective mirror 43 at any point until after the club head passes the position it would to hit a ball, because the eyes have moved out of the line-of-sight of the mirror reflection, then there is excessive movement that can be addressed.

After the user has practiced his or her golf club swing with the golf instructional device 10 in a setting where a golf instructor has correctly positioned the components of the device, the user can take the device 10 to another location, such as at home, and in conjunction with the lessons detailed in an instructional manual (not shown), practice his or her swing technique outside of a formal instructional setting. The instruction manual typically takes the form of a paper notebook, but could be in any form that manuals are currently kept, or will be in the future, such as on a CD-ROM or any other media storage form, such that the teachings of the manual can be accessed by the golfer from any location and with any device, such as a computer, personal digital assistant, or similar electronic device. Because the angle of tilt of the mirror and frame assembly 14 and the position of the markers 12, 13 and 15 and the wedge 16 on the mat have been set by the instructor, and the lessons learned in the instructional setting are reiterated in the instructional manual, the user can repeat his or her golf swing in proper form according to the instructor's teachings and develop good habits. Over a period of time, or upon advancements in technique or flexibility observed by a golf instructor, the instructor can change the position and angle of the components of the present invention to further develop the proper form of the user's golf swing.

As mentioned above, the instructional device 10 can be used in conjunction with the instructional manual to give the user further guidance in reinforcing a specific swing or "muscle memory" technique outside of the instructional setting. The manual is divided into sections to correspond with specific techniques taught during each instructional lesson. Ideally, the student learns and practices the contents of one lesson at a time in an instructional setting with a golf instructor, and the device 10, before the student uses the device 10 and instructional manual to practice alone at-home or other setting without the instructor. In this way, each individual section of the manual is not read by the user until the golf instructor directs them to do so. Bad muscle-memory is avoided because the user is prevented from practicing any part of the swing before receiving good instruction.

The combination of using the instructional manual with the instructional device 10 provides guidance to golf instructors on what and how to teach proper golf club swinging techniques. It is widely known in the golf industry that the teaching a correct "feel" of how to swing a golf club is very difficult and that neither demonstrations nor words can directly accomplish this goal. Providing an instructional device 10 with a set of instructions for repeating club swing techniques learned in a golf lesson facilitates the user's ability to achieve such a "feel" in his or her golf game.

Thus, the device 10 and instructional manual work together as follows. First, the instructor uses the mat to indicate the customized-correct pre-swing body and club positions for the student. Second, the instructor teaches the correct swing to the student in a series of lessons. These lessons include teaching the student how, and the importance of, being able to see his/her eyes in the mirror continuously until after the ball has been struck. Because initially the setup position and swinging of a club as taught with the present invention feel somewhat uncomfortable and instinctively wrong to the golfer, the user must practice the setup and swing daily until everything feels comfortable and instinctively right. Most golf students are unsuccessful at developing correct setup, swing and stretching habits because (a) they forget the many important details taught by the golf instructor, and therefore practice incorrectly and develop bad muscle-memory, and (b) they can't practice enough because of the difficulty of getting to a golf practice range. The combination of the device 10 and instructional manual make it possible for golfers to practice often enough and in correct form as to develop good muscle-memory. This is because, as the manual explains and instructs, the user can practice indoors in slow motion, without a ball. The markers on the mat ensure that the user's setup is correct. The mirror and frame assembly 14 ensures that the student learns to swing in balance, and the head remains relatively steady until after impact. Because the manual describes and illustrates what the instructor taught during each lesson, the student remembers what was taught and is ensured of practicing correctly and developing correct muscle-memory.

From the forgoing information, it should now be obvious that the golf instructional device 10, especially when used in conjunction with the associated instructional manual, provides a training device that can be customized to meet the individual needs of a particular golfer and can more accurately monitor the required fundamentals of a good golf swing. The attachments of the device 10 are adjusted by a golf instructor to enable a golfer to improve his or her skills both during formal instruction and during practice sessions where the student is alone, and at any location desired. It is to be understood that the present invention can use other attachment means in addition to those disclosed herein for removably attaching the components of the invention to the support mat 11, as future technologies may be developed to provide a similar function. Furthermore, while certain forms of the present invention have been illustrated and described herein, it is not to be limited to the specific forms or arrangement of parts described and shown.

What is claimed is:

1. A golf instructional device configured for customization for an individual user and for controlling a line of sight for the user's eyes during a backswing portion of a club swing, the device comprising:

a mat having a support surface;

two or more foot positioning markers removably attached to the mat surface to indicate proper placement of each foot of the user, each of the two or more foot positioning markers being selectively removable to optimize the proper placement of the two or more foot positioning markers for the individual user;

a club positioning marker removably attached to the mat surface to indicate proper pre-swing club setup alignment; and a mirror having a leading edge and a trailing edge, the mirror being adjustably coupled to the mat such that the mirror as adjusted enables the user prior to a club swing to see a reflection of the user's eyes in the mirror as the user stands per the foot positioning markers and holds the club per the club positioning marker and such that the leading edge of the mirror is substantially adjacent to the reflection of the user's eye that is nearest to the leading edge of the mirror, the mirror being operably sized and configured such that forward lateral movement by the user's head and thus like movement of the line of sight of the user's eyes during the backswing portion of the club swing disrupts the user's vision of the reflection of the user's eyes from the mirror;

whereby the foot positioning marker, the club positioning marker and the mirror cooperatively provide the user with a properly designated setup position for swinging a golf club.

2. The instructional device of claim 1, wherein the two or more foot positioning markers comprises two foot positioning markers and wherein the mirror is positioned longitudinally between the two foot positioning markers.

3. The instructional device of claim 2, wherein the mirror has a length of about 4.5 inches and a width of about 1.75 inches.

4. The instructional device of claim 2, wherein the mirror comprises a frame and a reflective surface mounted onto the frame, and wherein the mirror is positioned adjacent to the mat and coupled thereto with an eye-screw extending laterally from a first side of the frame, the eye-screw configured to be received around a screw-peg extending upwardly from the mat surface.

5. The instructional device of claim 4, further comprising an angular adjustment means for positioning the mirror at a tilt angle relative to the mat surface to allow a user to view his or her eyes in the reflective surface while standing on the mat surface.

6. A golf instructional device configured for customization for an individual user, and for monitoring the location of a user's eyes while swinging a club, comprising:

a mat having a support surface;

two or more foot positioning markers removably attached to the mat surface to indicate proper placement of each foot of a user;

a club positioning marker removably attached to the mat surface to indicate proper pre-swing club setup alignment; and a mirror comprising a frame, a reflective surface mounted onto the frame, and a cam mounted to a second side of the frame opposite of the first end, the cam being configured to abut a surface located generally below the frame for positioning the mirror at a tilt angle relative to the mat surface to allow a user to view his eyes in the reflective surface while standing on the mat surface; the mirror being positioned adjacent to the mat and coupled thereto with an eye-screw extending laterally from a first side of the frame, the eye-screw configured to be received around a screw-peg extending upwardly from the mat surface;

whereby the foot positioning marker, the club positioning marker and the mirror cooperatively provide the user with a properly designated setup position for swinging a golf club.

7. The instructional device of claim 1, whereby removable attachment of the two or more foot positioning markers and the club positioning marker is accomplished by affixing a hook component of a hook and loop system to a surface of each and having the mat surface configured to serve as the corresponding loop component to allow for adjusting the locations of the two or more foot positioning markers and the club positioning marker on the mat surface.

8. The instructional device of claim 1, further comprising a wedge removably attached to the mat surface for placement under at least a portion of one foot of a user to aid in training the user to maintain a near-stationary back leg during the entire backswing.

9. The instructional device of claim 1, further comprising a centering marker located on the mat for designating a reference position about which a user will position his or her body nearly parallel to a line running from the ball to a target to guide the user in swinging a golf club in the proper fashion.

10. The instructional device of claim 1, further comprising a golf ball marker located on the mat to designate the proper setup position of a golf club head held by the user.

11. The instructional device of claim 1, wherein the support mat has a first end and a second end and further comprises a closure mechanism for coupling the first end to the second end to secure the mat in a folded arrangement.

12. The instructional device of claim 1, wherein the support mat has a first end having a hole and a second end, and further comprising a toggle mechanism connected to the second end of the mat whereby the mat can be secured in a folded position by insertion of the toggle into the hole of the first end.

13. The instructional device of claim 1, wherein the mirror is adjustable to a tilt angle relative to the mat surface, and wherein placement and attachment of the two or more foot positioning markers and the club positioning marker on the support mat, as well as the selection of a tilt angle for the mirror, to designate proper setup positioning for swinging a golf club is conducted only by a golf instructor and not by the individual user of the mat.

14. A golf instructional device designed to improve a user's golf club swing technique by designating proper setup positioning for swinging a club based on the user's individual needs, the kit comprising:

a mat having a support surface;

two or more foot positioning markers removably attached to the mat surface to indicate proper placement of each foot of a user;

a club positioning marker removably attached to the mat surface to indicate proper pre-swing body and club setup alignment;

a mirror having a leading edge and a trailing edge, the mirror being adjustably coupled to the mat such that the mirror as adjusted enables the user prior to a club swing to see a reflection of the user's eyes in the mirror as the user stands per the foot positioning markers and holds the club per the club positioning marker and such that the leading edge of the mirror is substantially adjacent to the reflection of the user's eye that is nearest to the leading edge of the mirror, the mirror being operably sized and configured such that forward lateral movement by the user's head and thus like movement of the line of sight of the user's eyes during the backswing portion of the club swing disrupts a portion of the user's vision of the reflection of the user's eyes from the mirror; and an instructional manual containing teaching methods corresponding to specific lessons taught by a golf instructor, such teachings arranged within the manual in a manner as to facilitate the user reinforcing specific pre-swing set-up positioning and proper control of head motion during the club swing while outside the presence of the golf instructor.

* * * * *